US007293484B2

(12) United States Patent
Liu

(10) Patent No.: US 7,293,484 B2
(45) Date of Patent: Nov. 13, 2007

(54) OPENER HEAD RETAINER

(76) Inventor: Kuo-Chen Liu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/041,024

(22) Filed: Jan. 24, 2005

(65) Prior Publication Data

US 2006/0162508 A1 Jul. 27, 2006

(51) Int. Cl.
*B25B 23/16* (2006.01)
*B25G 1/08* (2006.01)

(52) U.S. Cl. ..... 81/177.4; 81/439; 81/490

(58) Field of Classification Search ..... 81/177.4, 81/439, 490
See application file for complete search history.

(56) References Cited

U.S. PATENT DOCUMENTS 6,327,942 B1 * 12/2001 Mariol et al. ..... 81/177.4
6,502,484 B2 * 1/2003 Pao-Hsi ..... 81/439
6,629,478 B2 * 10/2003 Kozak ..... 81/490
6,742,421 B1 * 6/2004 Chen ..... 81/490

* cited by examiner

*Primary Examiner*—David B. Thomas

(57) ABSTRACT

An opener head retainer comprises a handle held by users; a front end of the handle having a receiving groove; an operation portion capable of being inserted into the receiving groove; a receiving portion formed by a casing, an inserting disk, an elastomer, and a cover. An inner side of the casing has a receiving space for receiving the inserting disk and the elastomer. A periphery of the through hole has two lower inclined resisting sheets. A lower side of the inserting disk is enclosed by two upper inclined resisting sheets capable of resisting against the two lower inclined resisting sheets so to control the vertical orientation of the inserting disk in the casing. Each of the opener heads is placed between a corresponding one of the clamping groove and a corresponding one of the receiving openings.

7 Claims, 4 Drawing Sheets

OPENER HEAD RETAINER

FIELD OF THE INVENTION

The present invention relates to openers, and in particular to an opener head retainer, wherein each of a plurality of opener heads are placed between a corresponding one of the clamping groove and a corresponding one of the receiving openings. When rotating the casing, upper inclined resisting sheets move along lower inclined resisting sheet so that the opener heads in the clamping grooves are protruded out. Thereby the user can select a desired opener head for operation or update.

BACKGROUND OF THE INVENTION

The opener head retainers are more and more popular tools since generally, people need to receive the opener heads by a simple and easy way so that a plurality of opener heads can be carried easily for use. In one prior art, a periphery of a handle is formed with a plurality of receiving grooves for receiving opener heads. The handle is formed with a receiving hole for receiving a spring and a button. A periphery of a cover is formed with a plurality of hollowed grooves with proper lengths. One end thereof is formed with a via hole. A plurality of stoppers are installed in the inner end surface of the cover. A surface of a button has a plurality of protrusions corresponding to the stoppers. A periphery thereof has a notch corresponding to the receiving grooves. A post is formed on a center of the button. When it is necessary to update the opener head, the button is pressed, the protrusions will leave from the confinement of the cover. The notch of the button is exactly aligned to the receiving groove. Thereby a desired opener head can be selected. However, this way is inconvenient in taking the opener head. This is because the opener head is placed in the inner side of the handle. Although grooves are formed for taking the opener head, but the handle is too small and thus the grooves are narrow. Thereby the operation is inconvenient. Thereby for those having greater finger, it is especially inconvenient, even the opener head cannot be taken out. Thereby the opener heads annularly arranged around the handle cannot be seen clearly by the users. Thus the time for taking the opener head is long.

In another improved way, an opener rod can be installed with a receiving seat to resist against one end of the handle. The seat serves to receive a plurality of specific opener heads. When a required opener head is selected, the opener head is placed in a hexagonal hole of the opening rod. Thus the opener head is used to work. However in this way, it is necessary to open a cover as it is desired to take an opener head. If the cover is lost, it is easy to lose the opener heads. Furthermore, when it is desired to update the opener head, the user must take attention to the cover. The operation is inconvenient. Thereby this way make the operation of receiving the opener heads easy, but it makes the operation of taking the opener heads inconvenient.

SUMMARY OF THE INVENTION

Accordingly, the primary object of the present invention is to provide an opener head retainer, wherein each of the opener heads is placed between a corresponding one of the clamping groove and a corresponding one of the receiving openings. When rotating the casing, the upper inclined resisting sheets move along the lower inclined resisting sheet so that the opener heads in the clamping grooves are protruded out.

To achieve above objects, the present invention provides An opener head retainer comprises a handle held by users; a front end of the handle having a receiving groove; an operation portion capable of being inserted into the receiving groove; a receiving portion formed by a casing, an inserting disk, an elastomer, and a cover. An inner side of the casing has a receiving space for receiving the inserting disk and the elastomer. A periphery of the through hole has two lower inclined resisting sheets. A lower side of the inserting disk is enclosed by two upper inclined resisting sheets capable of resisting against the two lower inclined resisting sheets so to control the vertical orientation of the inserting disk in the casing. Each of the opener heads is placed between a corresponding one of the clamping groove and a corresponding one of the receiving openings. When rotating the casing, the upper inclined resisting sheets move along the lower inclined resisting sheet so that the opener heads in the clamping grooves are protruded out.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figures 1, 2:
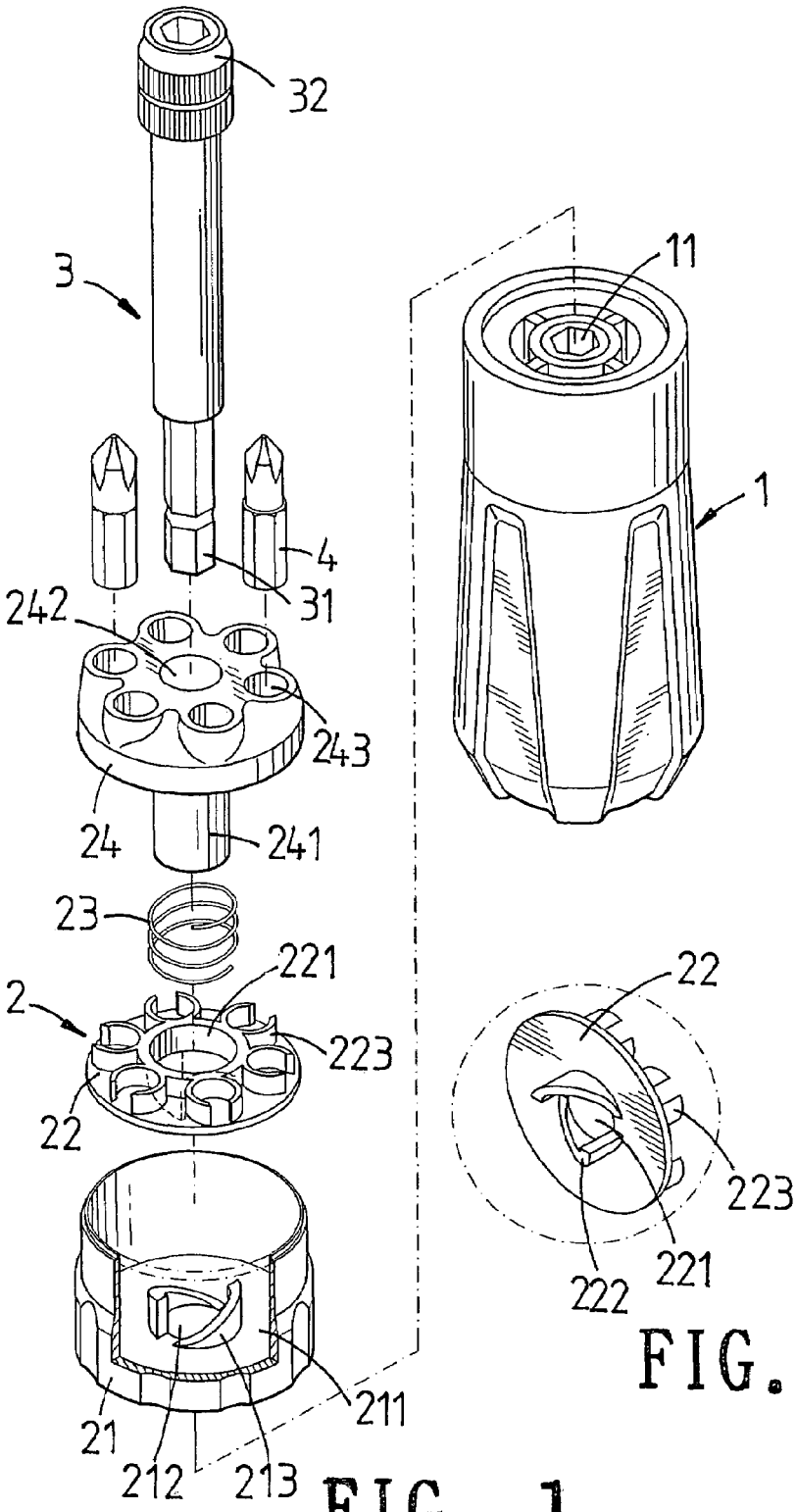
FIG. 1 is an exploded perspective view of the opener head retainer of the present invention.
FIG. 2 is a perspective view of the opener head retainer of the present invention, which is viewed from another viewing angle.
Figure 3:
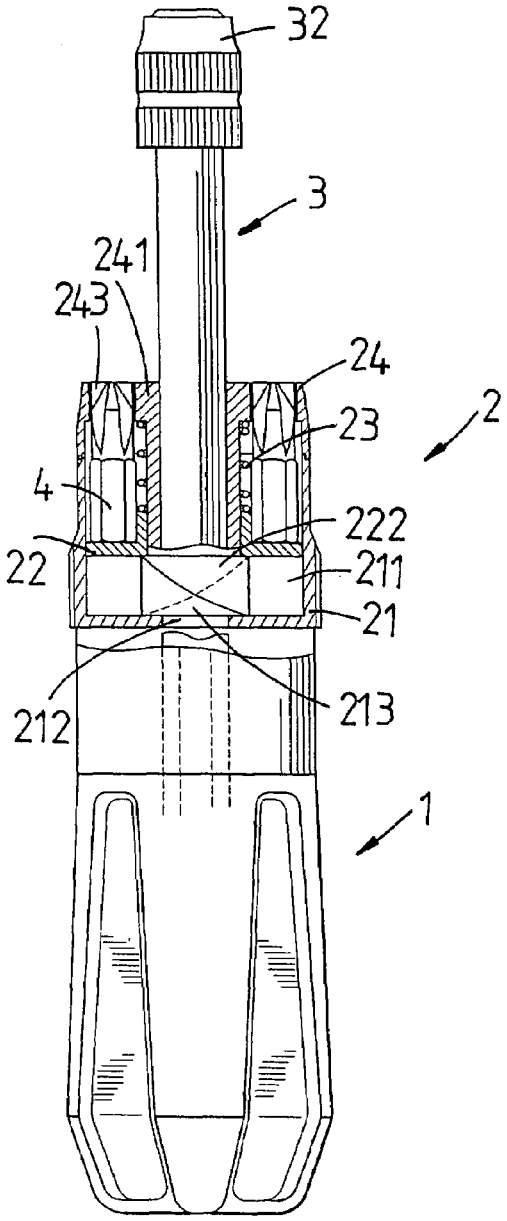
FIG. 3 is a lateral cross sectional view of the opener head retainer of the present invention.

Referring to FIGS. 1 to 3, the opener head retainer of the present invention is illustrated. The opener head retainer has the following elements.

A handle 1 is held by users. A front end of the handle 1 has a receiving groove 11.

An operation portion 3 is capable of being inserted into the receiving groove 11. The opener head 4 is a slender rod. A distal end of the operation portion 3 has a combining rod 31 corresponding to the receiving groove 11 of the handle 1. The combining rod 31 can be tightly engaged to the receiving groove 11. A front end of the operation portion 3 has a work piece head 32 for receiving an opener head 4. The work piece head 32 is replaceable for receiving different kinds of the opener head 4.

A receiving portion 2 is formed by a casing 21, an inserting disk 22, an elastomer 23, and a cover 24. An inner side of the casing 21 has a receiving space 211 for receiving the inserting disk 22 and the elastomer 23. A lower end of the receiving space 211 has a through hole 212. The operation portion 3 passes through the through hole 212. A periphery of the through hole 212 has two lower inclined resisting sheets 213 which enclose the through hole 212. A center of the inserting disk 22 has a via hole 221. A lower side of the inserting disk 22 is enclosed by two upper inclined resisting sheets 222 capable of resisting against the two lower inclined resisting sheets 213 so to control the vertical orientation of the inserting disk 22 in the casing 21. A front end of the inserting disk 22 is a plurality of clamping grooves 223 distributed around the via hole 221 of the inserting disk 22. The clamping groove 223 is elastic for clamping the opener head 4. The cover 24 is capable of covering an outlet of the receiving space 211 of the casing 21 for confining the elastomer 23 and the inserting disk 22 to the receiving space 211. A lower end of the cover 24 is protruded with a positioning rod 241. The positioning rod 241 passes through the via hole 221 of the inserting disk 22. A front center of the cover 24 has a penetrating hole 242. The positioning rod 241 is penetrated by the penetrating hole 242. The operation portion 3 passes through the penetrating hole 242 and thus the cover 24 is tightly engaged to the operation portion 3. A periphery of the penetrating hole 242 of the cover 24 has a plurality of receiving openings 243 corresponding to the clamping grooves 223 of the inserting disk 22.

Figure 4:
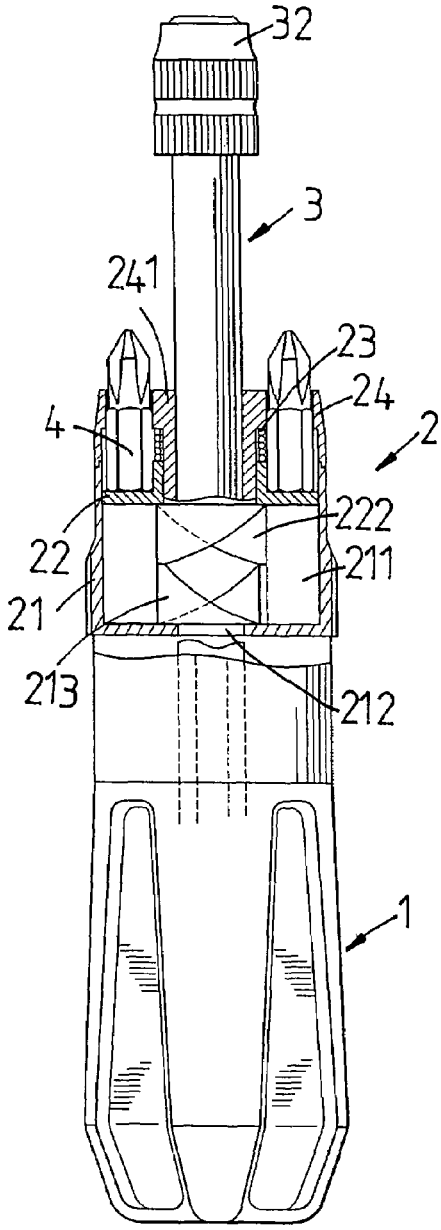
FIG. 4 is a lateral view about the operation of the opener head retainer of the present invention.
Figure 5:
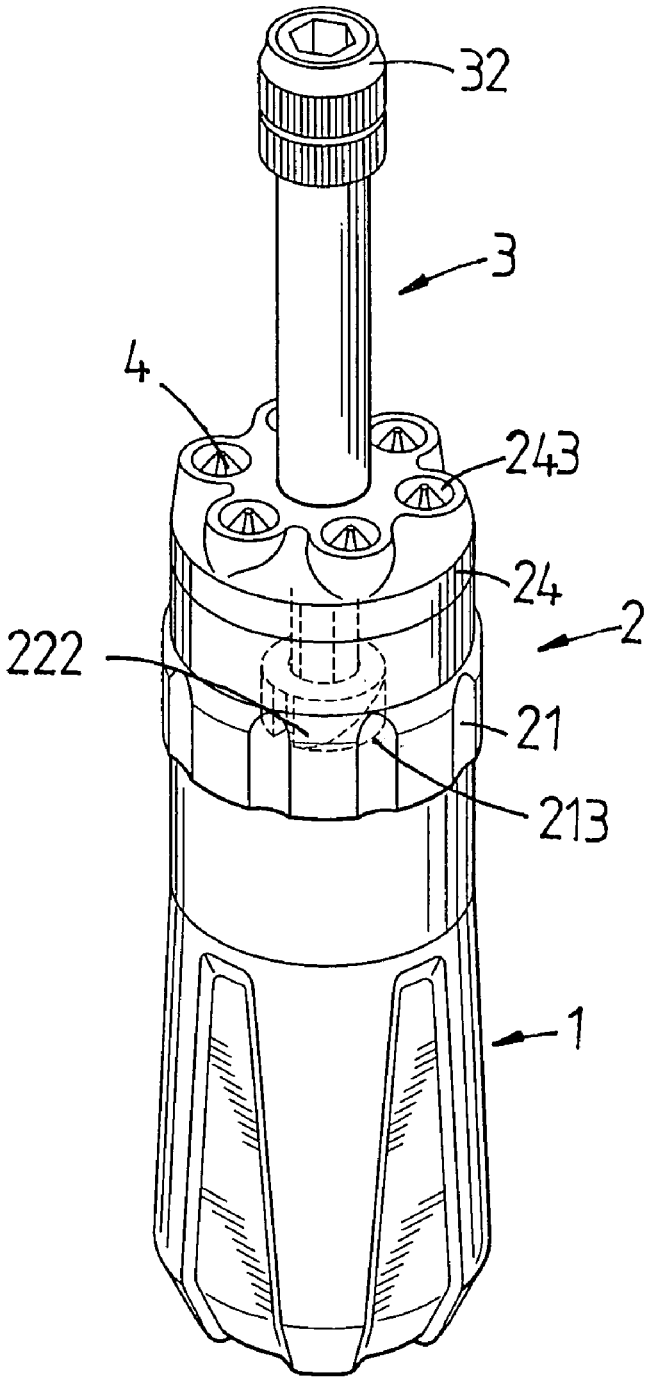
FIG. 5 is a perspective view about the opener head retainer of the present invention.

Referring to FIGS. 4 and 5, in assembly of the present invention, the inserting disk 22 is firstly placed in the receiving space 211 of the casing 21. The upper inclined resisting sheets 222 of the inserting disk 22 are at the side locating the lower inclined resisting sheets 213 of the casing 21 and thus resist against the lower inclined resisting sheets 213. The elastomer 23 encloses the positioning rod 241 of the casing 21. Then the cover 24 covers the outlet of the receiving space 211 of the casing 21 so that the positioning rod 241 is combined to the inserting disk 22 and thus the inserting disk 22 and the elastomer 23 are confined within the receiving space 211 of the casing 21. Thereby the assembly of the receiving portion 2 is complete. The combining rod 31 of the operation portion 3 inserts into the penetrating hole 242 of the cover 24 of the receiving portion 2 and then passes through the via hole 221 of the inserting disk 22. Then the combining rod 31 passes out from the through hole 212 of the casing 21. The positioning rod 241 of the cover 24 is tightly engaged to the operation portion 3. The combining rod 31 of the operation portion 3 is received in the receiving groove 11 of the handle 1 so that the operation portion 3 is combined to the handle 1. Therefore the assembly of the receiving portion of the present invention is complete, as shown in FIG. 5.

Figure 6:
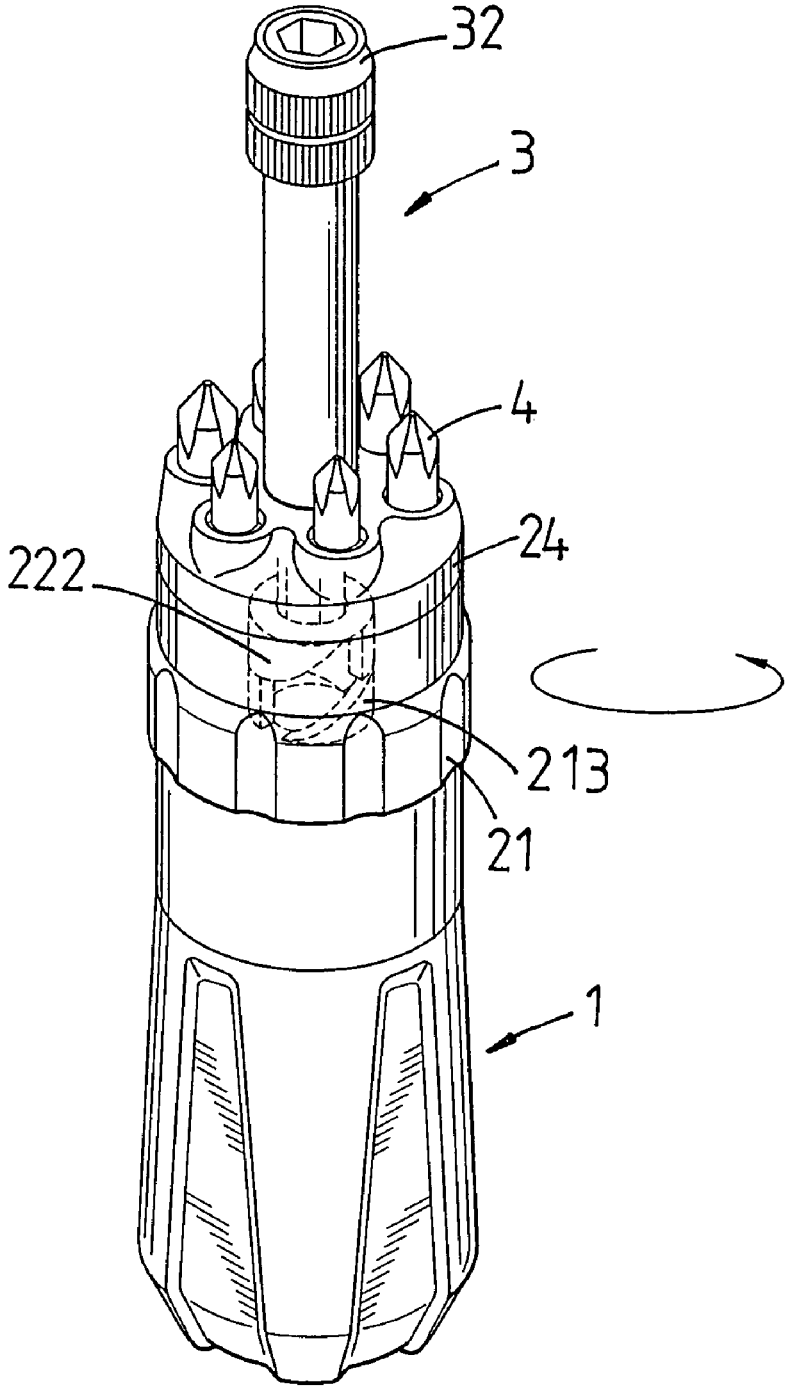
FIG. 6 is a perspective view about the operation of the opener head retainer of the present invention.

Referring to FIG. 6, in use of the present invention, unused opener heads 4 insert into one of the receiving openings 243 so that the opener heads 4 are received within the receiving portion 2. The rear ends of the opener heads 4 are clamped in the clamping grooves 223. When it is desired to take an opener head 4, a force is applied to the casing 21 of the receiving portion 2 so that the casing 21 rotates with respect to the cover 24. Then the upper inclined resisting sheets 222 of the casing 21 will move along the lower inclined resisting sheets 213 of the casing 21 so that the inserting disk 22 moves along the positioning rod 241 of the cover 24. The opener heads 4 in the clamping grooves 223 will move upwards so as to protrude out of the receiving openings 243 of the cover 24 so that the user can select a desired one. When one of the opener heads 4 is taken out, the opener head 4 is placed to the work piece head 32 at the front end of the operation portion 3 so as to screw a screw means. When it is desired to receive the protruded portion of the opener head 4 protruded from the receiving opening 243 of the cover 24, it is only necessary to rotate the casing 21 of the receiving portion 2 so that the top ends of the lower inclined resisting sheets 213 are aligned to the lower ends of the upper inclined resisting sheets 222 and the lower ends of the inclined resisting sheets 213 are aligned to the tops of the upper inclined resisting sheets 213. Then the inserting disk 22 will be ejected by the elastic forces of the elastomer 23 so as to move back to the lower side of the casing 21. The opener heads 4 clamped in the clamping grooves 223 of the inserting disk 22 will also return to the receiving portion 2 so as to complete the work of receiving the opener heads 4.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An opener head retainer comprising:

a handle held by users; a front end of the handle having a receiving groove;

an operation portion capable of being inserted into the receiving groove;

a receiving portion formed by a casing, an inserting disk, an elastomer, and a cover; an inner side of the casing having a receiving space for receiving the inserting disk and the elastomer; an upper side of the casing having two lower inclined resisting sheets; a lower side of the inserting disk being enclosed by two upper inclined resisting sheets capable of resisting against the two lower inclined resisting sheets so to control the vertical orientation of the inserting disk in the casing; a front end of the inserting disk being a plurality of clamping grooves for clamping the opener head; the cover being capable of covering an outlet of the receiving space of the casing for confining the elastomer and the inserting disk to the receiving space; the cover having a plurality of receiving openings corresponding to the clamping grooves of the inserting disk so that each of the opener heads is placed between a corresponding one of the clamping grooves and a corresponding one of the receiving openings;

wherein when rotating the casing, the upper inclined resisting sheets move along the lower inclined resisting sheet so that the opener heads in the clamping grooves are protruded out.

2. The opener head retainer as claimed in claim 1, wherein the upper inclined resisting sheets are arranged as a round shape and the lower inclined resisting sheets are arranged as a round shape.

3. The opener head retainer as claimed in claim 1, wherein a center of the inserting disk having a via hole; a lower end of the cover is protruded with a positioning rod; the positioning rod passes through the via hole of the inserting disk; and the elastomer encloses the positioning rod so that the inserting disk resists against the elastomer.

4. The opener head retainer as claimed in claim 3, wherein a front center of the cover has a penetrating hole; the positioning rod is penetrated by the penetrating hole; the operation portion passes through the penetrating hole and thus the cover is tightly engaged to the operation portion; a periphery of the penetrating hole of the cover has a plurality of receiving openings corresponding to the clamping grooves of the inserting disk.

5. The opener head retainer as claimed in claim 4, wherein the clamping grooves are elastic; a lower end of the receiving space has a through hole; the operation portion passes through the through hole; a distal end of the operation portion has a combining rod corresponding to the receiving groove of the handle; and the combining rod can be tightly engaged to the receiving groove.

6. The opener head retainer as claimed in claim 5, wherein a front end of the inserting disk has the plurality of clamping grooves distributed around the via hole of the inserting disk.

7. The opener head retainer as claimed in claim 1, wherein a front end of the operation portion has a work piece head for receiving an opener head; and the work piece head is replaceable for receiving different kinds of the opener head.

* * * * *